US005329745A

United States Patent [19]

Suga

[11] Patent Number: 5,329,745

[45] Date of Patent: Jul. 19, 1994

[54] PACKAGING MACHINE SEAL MECHANISM APPARATUS/METHOD AND CONTROL

[75] Inventor: Yasutaka Suga, Ibaraki, Japan

[73] Assignees: Ossid Corporation, Rocky Mount, N.C.; Ibaraki Seiki Machinery Company, Ltd., Ibaraki, Japan

[21] Appl. No.: 978,324

[22] Filed: Nov. 18, 1992

[30] Foreign Application Priority Data

Apr. 15, 1992 [JP] Japan ..... 4-121444

[51] Int. Cl.[5] ..... B65B 9/06; B65B 51/30; B65B 57/00

[52] U.S. Cl. ..... 53/75; 53/450; 53/550

[58] Field of Search ..... 53/75, 55, 66, 550, 53/548, 450, 479, 477, 373.5, 373.7, 374.5, 374.6

[56] References Cited

U.S. PATENT DOCUMENTS

| | | | |
|---|---|---|---|
| 4,063,400 | | Millevoi | 53/548 |
| 4,553,377 | 11/1985 | Klinkel | 53/550 X |
| 4,768,327 | 9/1988 | Mosher | 53/75 X |
| 4,914,889 | 4/1990 | Francioni | 53/550 X |
| 4,964,258 | 10/1990 | Seko et al. | 53/75 |

*Primary Examiner*—James F. Coan
*Attorney, Agent, or Firm*—Olive & Olive

[57] ABSTRACT

A packaging machine of the type having a mechanism for tubulating a belt-like film and a conveyor for transferring products into the tubular film is typically equipped with a pair of sealing bars which produce transverse seals between the products being packaged. The present invention relates to a mechanism which is able to control the length and speed of the stroke of the sealing bars and the speed of the film dependent on the length of the product being packaged which assures more uniform heating of the seals resulting overall in more uniform transverse seals.

9 Claims, 7 Drawing Sheets

PACKAGING MACHINE SEAL MECHANISM APPARATUS/METHOD AND CONTROL

FIELD OF THE INVENTION

The invention relates to packaging apparatus and methods for wrapping longitudinally conveyed products in a tubular formed heat sealable film which is heat sealed transverse to the direction of movement between the products and more particularly to an apparatus and method for controlling the stroke and speed of the transverse sealing mechanism when the length of the package is changed.

BACKGROUND OF THE PRIOR ART

A conventional product packaging machine which utilizes a heat sealable film, moves both the product and the film in a longitudinal direction, bonds the film edges together to form a tube around the product and seals the tube transversely has generally the construction shown in FIGS. 11 and 12. The term "product" is used to refer to any product, item, material or anything else that might be packaged by the type machines being presently and hereafter described. Referring further to FIGS. 11 and 12, a thermoplastic film in a roll 1 supported by rolling shafts 2 is supplied by a pullout roller 3 and a tension belt 4 and establishes film tube 7 of this belt-like film 5 by passing it over a cylinder making former 6. A continuous stream of to-be-wrapped products 10 are supplied, equidistantly spaced, into the tubular film 7 by the pushing force of attachments 9 disposed on endless chains of a chain conveyor 8, and the tubular film 7 is clamped and fused transversely between the to-be-wrapped products 10 by a pair of seal bars 11, 12 disposed transversely across the tubular film 7.

As seen in FIG. 12, a lever 15, supported pivotally by a pin 14 on a machine frame 13, is connected by a link 18 to a reciprocating frame 17, supported slidably on a guide 16, and the lever 15 is caused to swing back and forth by the rotation of a grooved cam 19. Accordingly, the reciprocating frame 17 reciprocates along the guide 16 as represented by an arrow. On the other hand, the seal bars 11, 12 connected by links 21, 22 are brought close to, and then away from, one another by the rocking operation of the bell crank 20 as generated by internal mechanism (not shown). Consequently, the seal bars 11, 12 move along a pair of elliptical paths as represented by an arrow 23 in FIG. 11 enabling a transverse sealing of tubular film 7 for an extended time.

When the length of the to-be-wrapped products 10 sent by the chain conveyor 8 is changed, a sensor 24 reads the length of the to-be-wrapped products 10 and inputs this length value as a digital value to a microcomputer 25. The microcomputer 25 generates signals 26, 27 corresponding to the length of the to-be-wrapped products by its arithmetic operation. Signal 26 is sent to a first motor 28 (FIG. 11) and the signal 27 is sent to a second motor 29 (FIG. 12). These motors change the rotating speeds of the pullout roller 3, the tension belt 4 and the grooved cam 19. In other words, since a third conveyor drive motor 30 in FIG. 11 always keeps a fixed speed to drive products through the machine, the film speed must be lowered in the case of a product 10*a* having a small length in order to keep constant the gaps 31, 32 between the adjacent products 10*b* in FIG. 13, and the film speed must be increased, on the contrary, in the case of a product 10*b* having a greater length. The reciprocating speed of the seal bars 11, 12 is synchronized with the film speed thus changed.

PROBLEM TO BE SOLVED BY THE INVENTION

The seal mechanism control apparatus described above involves the problem that the heating time to form the transverse seams is changed whenever the length of the to-be-wrapped product is changed. In other words, the reciprocation stroke of the frame 17 is always constant in the apparatus of FIG. 12. Therefore, when the rotating speed of cam 19 is increased so as to increase the speed of the frame 17, the contact time of both seal bars naturally decreases accordingly. There is a problem in that the seam seal time becomes shorter and the seal cannot be effectively reliable.

SUMMARY OF THE INVENTION

To solve the problems described above, there is provided a packaging machine which includes a mechanism for gradually tubulating a belt-like film in a longitudinal direction of the film and conveying the film, a feed conveyor for equidistantly transferring to-be-wrapped products into the tubular film, a mechanism for transmitting going motion of a main lever swinging through a selected arc to a frame through a connecting link and reciprocating the frame in the direction in which the tubular film is being transferred and a sealing mechanism for transversely clamping the tubular film by a pair of seal bars supported on the frame and which heat and seal the film as the frame moves synchronously with the tubular film and in the same direction. An operation control apparatus for the seal mechanism has a screw shaft disposed on the main lever and connected to a first drive motor. The frame is connected to a slider by a link. The slider is threadably meshed with the screw shaft. A control mechanism for the described packaging machine of the invention, according to a first embodiment (FIG. 8) for generating control signals to control the first motor and a second motor adapted for conveying the film is disposed so as to receive and calculate a value of the length of to-be-wrapped products transferred from the feed conveyor into the tubular film as input data, and to let the position of the slider on the main lever and the transport speed of the film correspond to the value of the length of the to-be-wrapped product.

The control mechanism for the described packaging machine of the invention is configured according to a second embodiment (FIG. 9) wherein, after the value of the length of the to-be-wrapped product transferred from the feed conveyor into the tubular film is accepted by the control mechanism as input data, the rotating angle of the first drive motor is first controlled on the basis of this input data and then the rotating speed of the second motor is controlled in proportion to the operating state of the first motor feedback from a rotation angle detector connected to the first motor to the control mechanism so that the position of the slider on the main lever and the transport speed of the film correspond to the value of the length of the to-be-wrapped product.

The control mechanism for the described packaging machine of the invention is configured according to a third embodiment (FIG. 10) so that, after the value of the length of the to-be-wrapped product transferred from the feed conveyor into the tubular firm is accepted by the control mechanism as the input data, the rotating speed of the second motor is first controlled on the basis of the input data, and then the rotating angle of the first motor is controlled in proportion to the operating speed of the second motor fed back from a rotation speed detector connected to the second motor to the control mechanism so that the position of the slider on the main lever and the transport speed of the film correspond to the value of the length of the to-be-wrapped product.

In the invention of the apparatus described according to the first embodiment, when the value of the length of the to-be-wrapped products transferred from the feed conveyor into the tubular film is digitized and inputted to the control mechanism, an arithmetic unit of the control mechanism controls the stroke of the seal bars in the reciprocating direction and the transport speed of the film in such a manner that they correspond to the digital signals. In other words, the control signal sent from the control mechanism to the first motor causes the first motor to rotate the screw shaft and causes displacement of the slider engaged with the screw shaft along the main lever. The swinging distance of the slider becomes smaller as the slider gets closer to the pivotal point of the main lever, and the swing speed is proportionally reduced. The swing distance and the speed become greater, on the contrary, as the slider is moved farther from the pivotal point of the main lever. Since the slider is interconnected to the sealing bars frame through the connecting link, the motion of the slider is directly transmitted to the frame. On the other hand, the speed of the film is controlled corresponding to the reciprocating speed of the frame by the control signal sent from the control mechanism to the second motor. Accordingly, when the length of the to-be-wrapped product is changed to a greater value, the reciprocating speed of the seal bars supported by the frame increases, so that the film speed, too, is increased by a proportional amount. Since the film clamping time of the seal bars becomes longer in proportion to the increase of the speed of the frame, control can be made so that the heating time of the film by the seal bars can be kept always constant irrespective of the size of the to-be-wrapped products.

DESCRIPTION OF THE PREFERRED EMBODIMENT

Figure 6:
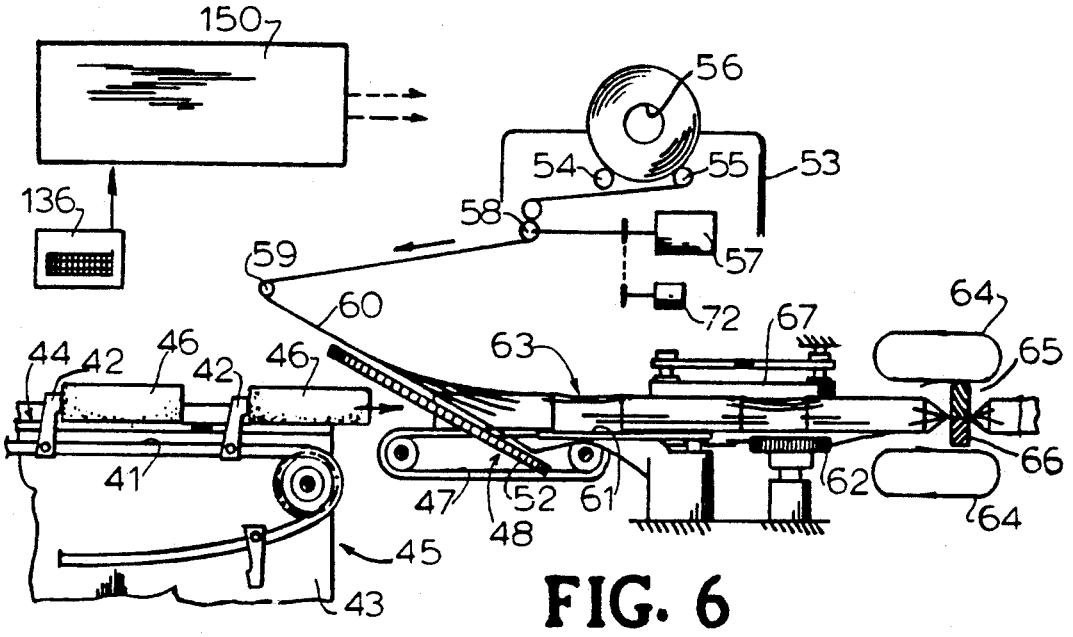
FIG. 6 is a side elevation view of a packaging machine according to the invention.
Figure 7:
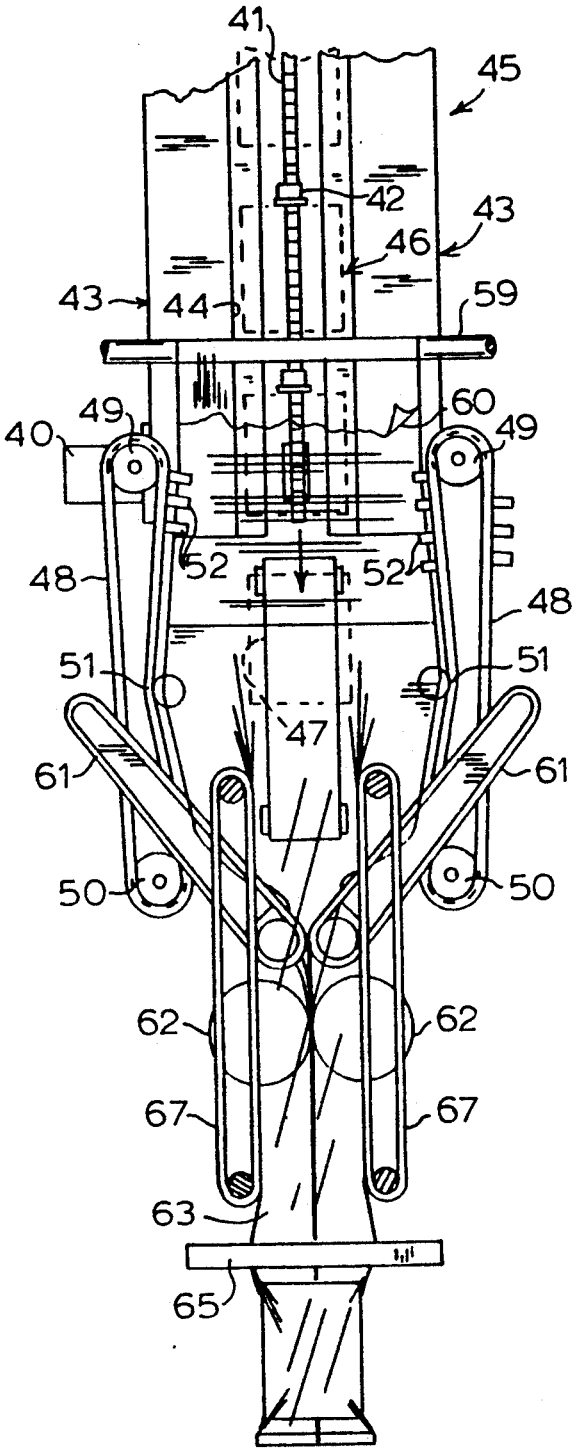
FIG. 7 is a top plan view of the packaging machine of FIG. 6.

Making reference initially to FIGS. 6 and 7, there is shown a preferred packaging machine apparatus used with each of the later described three embodiments of the control mechanism of the invention. A feed conveyor 45 is constituted by a number of equidistantly spaced attachments 42 on an endless chain 41 driven at a predetermined speed by a motor 40 and forming grooves 44 at the center of the upper surface of frames 43, 43 disposed on both sides of the chain 41. The feed conveyor 45 can slide each to-be-wrapped product 46 pushed by each attachment 42 inside the groove 44 and can transfer the product 46 to a conveyor 47 as represented by an arrow. A pair of side chains 48, 48 are each supported by two sprockets 49, 50 and one tension wheel 51, respectively, on both sides of the conveyor 47. As shown in FIG. 6, side chains 48 are disposed in such a manner as to incline downward in the transferring direction of product 46, and each side chain 48 is equipped with a large number of equidistantly spaced clampers 52. These clampers 52 have a structure similar to that of known document clips, wherein a clamping force is provided ordinarily by a spring, and this clamping force is released only when the clamper 52 is in touch with a round cam (not shown) disposed at each sprocket 49, 50.

In FIG. 6, a supply roll 56 of a heat sealable film 60 is supported on two rod-like rollers 54, 55 disposed rotatably on a machine frame 53. The film 60 is guided to a position between side chains 48, 48 by a drive roller 58 receiving the rotating power of a motor 57 and passes around a roller 59 to change the film direction. The belt-like film 60 is drawn diagonally downward by the motion of both chains 48, 48 while being supported along its edges by the series of clampers 52. The gap between side chains 48, 48 is expanded in the vicinity of the tension wheels 51 (FIG. 5B) at the intermediate portion of the chains 48. As a result the film 60 is stretched laterally and is put on top of the to-be-wrapped product 46. Both side edges of the film 60, which are released from the clampers 52 by releasing cams located proximate the sprockets 50, are pulled to the center by the rotation of a pair of opposed, high-friction belts 61, 61 disposed in a V shape as viewed in FIG. 7 and the film side edges are fused to each other by heat and clamping force applied by a pair of heat sealing rollers 62, 62. As a result, a continuous stream of products 46 are wrapped while being arranged equidistantly inside the tubular film 63, and a pair of seal bars 65, 66 operate along a pair of mirror-image elliptical paths 64, 64 (represented by arrows), with the film tube and product movement being further assisted by side belts 67, 67 on both sides of conveyor 47. The tubular film 63 is fused between successive products 46 in a direction transverse to the axis of film tube 63. The packaging machine thus far described in reference to FIGS. 6 and 7 is not novel in most of its structures, and is disclosed in U.S. Pat. No. 4,144,697, the teachings of which are incorporated herein by reference.

As an addition to and modification of the basic packaging machine described above, the invention provides a novel mechanism for operating the seal bars 65, 66 in an elliptical path and is constructed as illustrated in FIGS. 1A, 1B, 2, 3 and 4. Further, as later described, the invention provides three embodiments of a control mechanism (FIGS. 8, 9 and 10) for the novel sealing mechanism of the invention.

Figure 2:
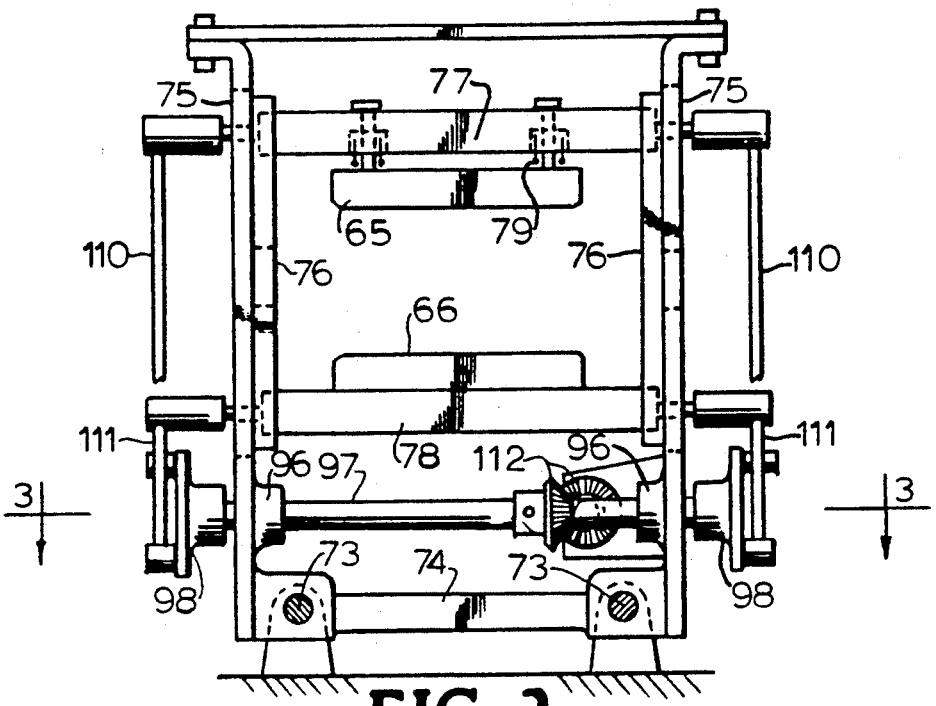
FIG. 2 is a front elevation view of the sealing mechanism of FIG. 1A.
Figure 3:
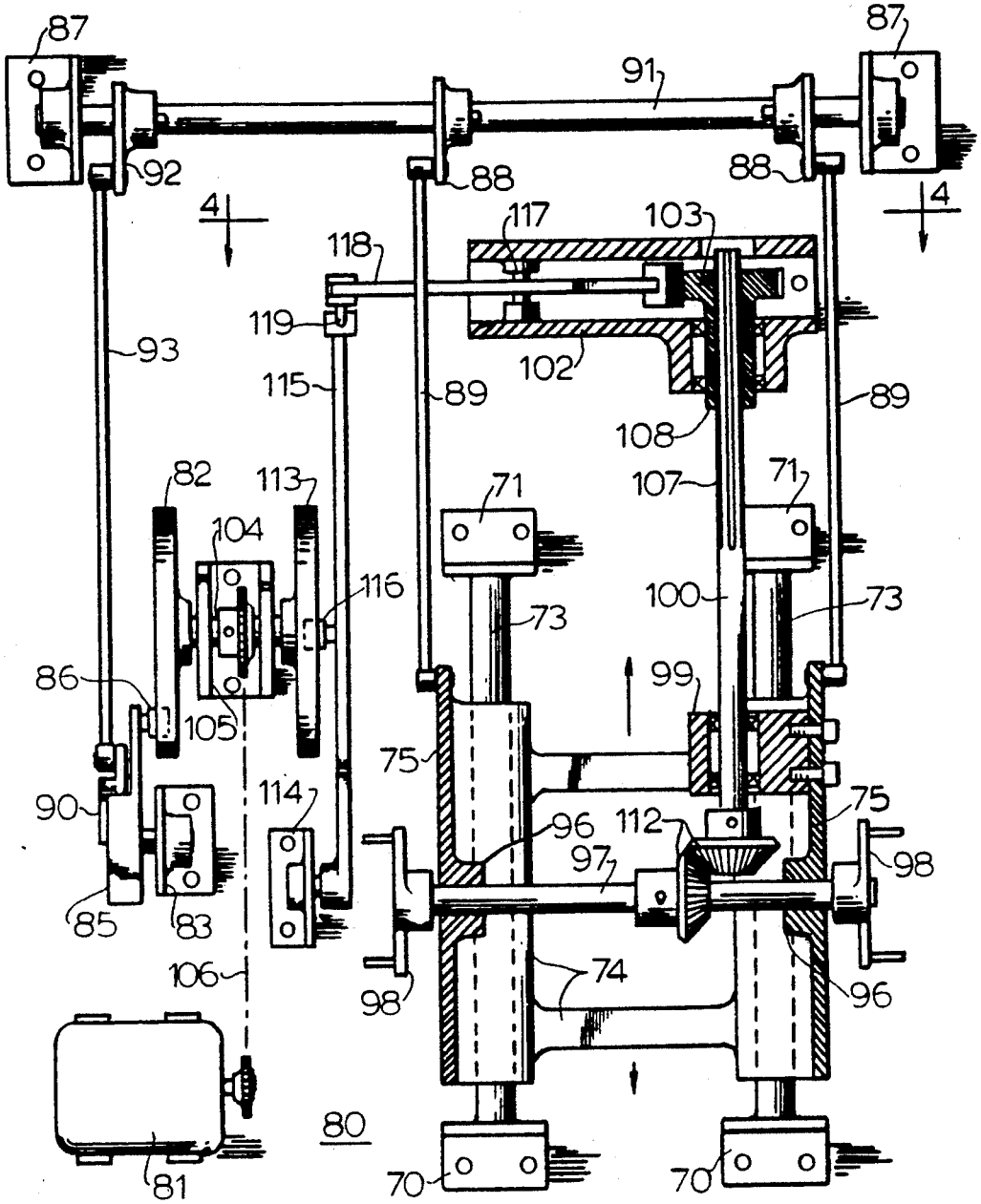
FIG. 3 is a sectional view of a portion of the sealing mechanism taken along a line 3—3 in FIG. 2.

In detail, as shown in FIG. 3, two rod-like guides 73 are fixed in parallel to each other between four bracket members 70 and 71 fixed on the upper surface of a base 80 so that a frame 74 is slidably supported on the guides 73 to be movable in the direction indicated by arrows. Upper and lower bars 77 and 78, as shown in FIG. 2, engage at both ends of frame 74 with vertical guide rails 76 longitudinally formed at the inner surfaces of two wall plates 75 of frame 74. An upper seal bar 65 is provided at the lower surface of the upper bar 77 and is cushioned through cushion springs 79, and a lower seal bar 66 is firmly provided at the upper surface of the lower bar 78. Also, as shown in FIG. 3, a reversing shaft 97 is rotatably supported by a pair of bosses 96 formed at the wall plate 75 on both sides of the frame 74, with bell cranks 98 fixed to both axial ends thereof.

Figure 1A:
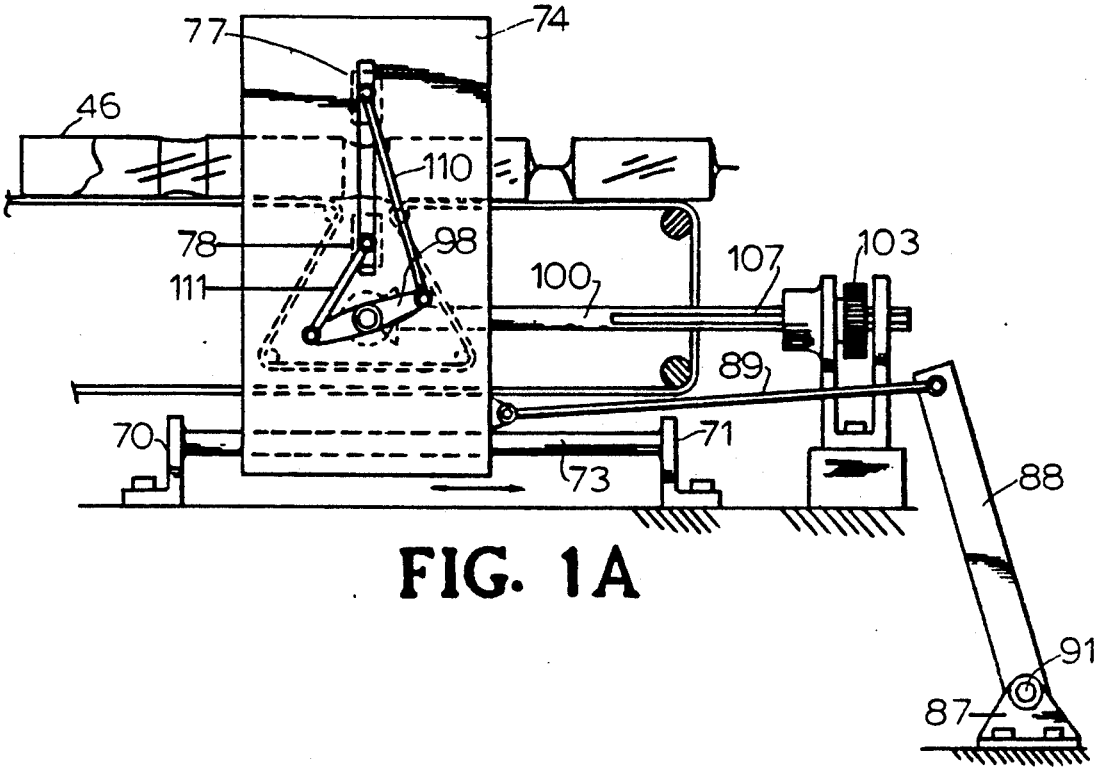
FIG. 1A is a side elevation view of the transverse sealing mechanism of the present invention.
Figure 1B:
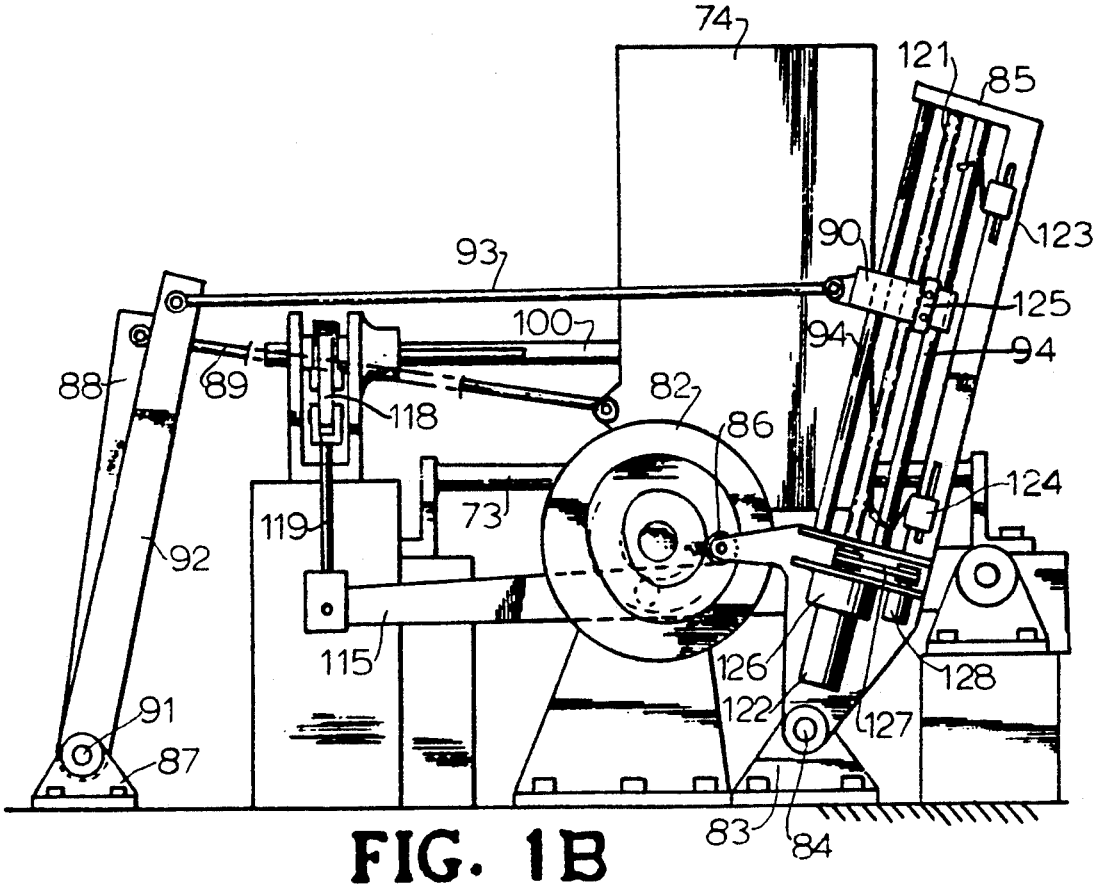
FIG. 1B is a side elevation view of an adjustable mechanism operative to actuate the sealing mechanism of FIG. 1A.

As shown in FIG. 1A, pins at both ends of each bell crank 98 and both ends of upper and lower bars 77 and 78 are connected by links 110 and 111. As shown in FIG. 3, a driving shaft 100 is rotatably supported by a bearing 99 attached to wall plate 75. The reversing shaft 97 and driving shaft 100 are connected with each other through a bevel gear set 112. A gear 103 is rotatably supported in a support structure 102 which is fixed to the base 80, and spline 107, axially formed at the peripheral surface of the driving shaft 100, slidably engages a spline bore 108 formed within the gear 103. Two lever bars 88 are fixedly attached to a shaft 91 which is rotatably supported between a pair of bearings 87 on the upper surface of the base 80. The lever bars 88 and both sides of the frame 74 are connected through two parallel rods 89. As shown in FIG. 1B, two shaft-like guides 94 are provided along a main lever 85 supported by a bracket 83 through a pin 84. A slider 90 is slidably supported on the guides 94. A driven lever 92, fixed to one end of the shaft 91 is connected to slider 90 through a rod 93. A pin 86 formed at the lateral side of main lever 85 engages an endless grooved cam 82. As shown in FIG. 3, the grooved cam 82 is supported by a bearing 105 through a shaft 104, and the shaft 104 is driven by a motor 81 through a chain 106. Therefore, when motor 81 rotates the grooved cam 82 shown in FIG. 1B, the main lever 85 swings at the upper end thereof around the lower pin 84. This swinging motion oscillates both the shaft 91 through the connecting rod 93 and the driven lever 92. In FIGS. 1A and 3, the shaft 91 is cyclically reversed so as to swing the upper ends of the two swinging levers 88, 88. As a result, the frame 74 through the connecting rods 89 repeats a corresponding motion along the rod-like guides 73. In this case, the driving shaft 100 axially slides in the spline bore 108 through the center of gear 103.

Figure 4:
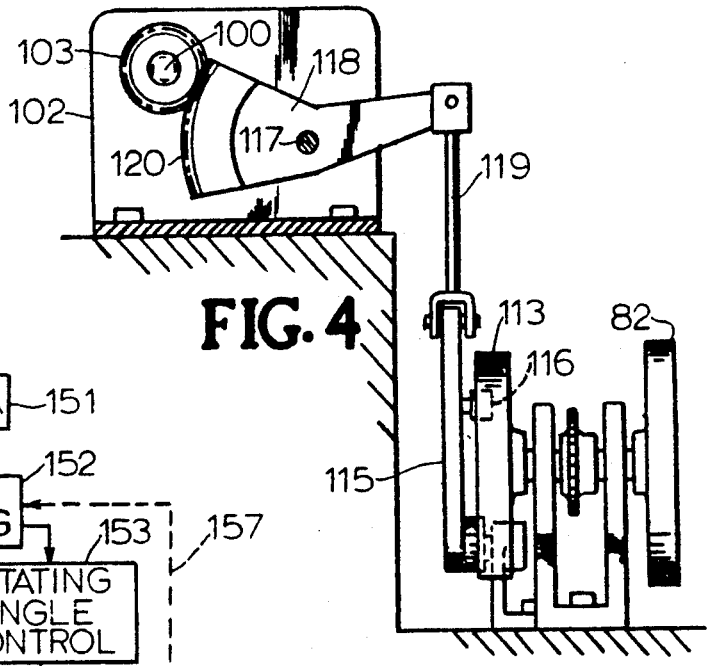
FIG. 4 is a sectional view of a portion of the sealing mechanism taken along a line 4—4 in FIG. 3.

A second grooved cam 113 is fixed to the second end of the shaft 104 supporting the grooved cam 82. A pin 116 provided at the lateral surface of a swinging arm 115 supported at one end by a bracket 114 engages the second grooved cam 113. As shown in FIG. 4, the opposite end of the arm 115 and the inner end of a gear segment 118, pivoted to the support structure 102 through a pin 117, are connected through a connecting rod 119. A circular-arc gear 120 is fixed to the other end of the gear segment 118 and engages with the gear 103. Therefore, the second grooved cam 113 rotates to vertically move the arm 115 at the outer end thereof so as to actuate the gear segment 118 around the pin 117, so that the gear 103 transmits reciprocating power to the driving shaft 100 throughout its sliding motion and further to reversingly move the shaft 97 and bell cranks 98, seen in FIG. 3, thereby moving both the bars 77 and 78 toward or away from each other. Accordingly, when both bars 77 and 78 move close to each other, the frame 74 is moved in the transportation direction of a wrapped product 46. When the frame 74 moves backwardly with respect to the transportation direction, both the bars 77 and 78 separate and remain away from each other, whereby the seal bars 65 and 66, mounted to the bars 77 and 78 travel along a long elliptical path 64 (see FIG. 6).

Returning to FIG. 1B, an internally threaded bore formed through the slider 90 engages with a screw shaft 121, rotatably provided between the two rod-like guides 94 of the main lever 85, so that the first motor 122 rotates screw shaft 121 through gear box 126 so as to move the slider 90 linearly along the rod-like guides 94. When a pusher 125 assembled onto the slider 90 comes into contact with either of the microswitches 123 or 124 provided on the main lever 85, the motor 122, and consequently slider 90, stop, thus providing a selected maximum moving range for slider 90 corresponding to the distance between the pair of switches 123 and 124. The shaft of the first motor 122 is connected through a belt 127 to a rotation angle detector 128 formed of an encoder.

Figure 5:
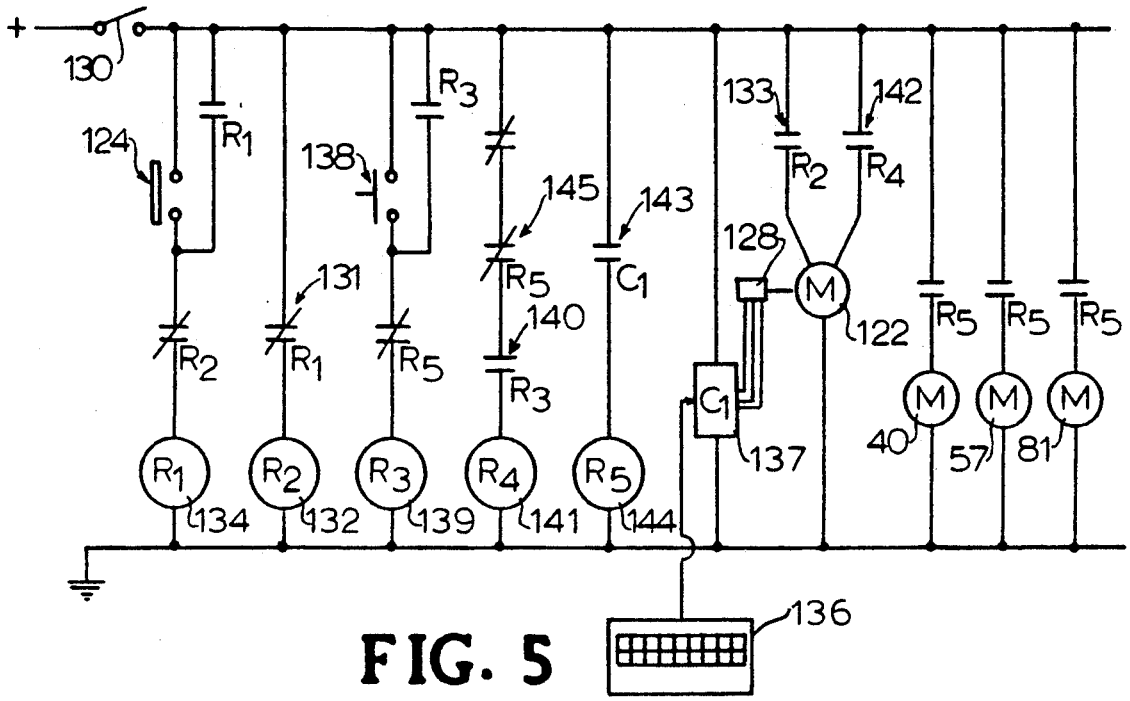
FIG. 5 is a schematic diagram of the electrical circuit of the invention.

A power supply switch 130, shown in the electrical diagram of FIG. 5, is manually closed to start the apparatus. Closing of switch 130 causes a relay coil 132 to be energized through a normally closed switch 131 and which acts to close a switch 133, thereby starting rotation of the first motor 122. First motor 122 rotates in the direction of lowering the slider 90 by the rotation of screw shaft 121, shown in FIG. 1B, which causes the slider 90 to contact and close the first switch 124 shown in FIG. 5. As a result, relay coil 132 is energized which causes switch 131 to open. This in turn causes switch 133 to open and the first motor 122 to stop, thus position-compensating the slider 90 in the zero point. In other words, regardless of the initial position of slider 90, it is lowered to the position where the first switch 124 contacts with the slider 90, thereby initializing the circuit. Thereafter, the operator operates a keyboard 136 to convert a known length of the wrapped product 46 into digital form and input it to a counter 137 in a microcomputer 150, and thereafter a second switch 138 is closed. This causes a relay coil 139 to close switch 140 and a relay coil 141 relationally closes a switch 142, whereby the first motor 122 starts its reverse rotation. Hence, the slider 90 in FIG. 1B starts to move upwardly along the rod-like guides 94. In FIG. 5, the rotation angle detector 128, driven by the rotation of the shaft of the first motor 122, gradually reduces numerical values stored by microcomputer 150 in the counter 137, so that simultaneously, when the stored numerical value of the counter 137 becomes zero, a switch 143 closes and energizes a relay coil 144 to open a normally closed switch 145. As a result, the switch 142 is opened by reason of relay coil 141 being energized to stop the first motor 122. Thus, in FIG. 1B, the slider 90 shifts only by an amount each time a command is given, always starting at the zero point. In addition, the upper switch 123 acts as a safety so as to prevent the slider 90 from moving further upward. In FIG. 5, simultaneously when the counter 137 excites the relay coil 144 through the switch 143, motors 40, 57 and 81 all operate to start the entire packaging apparatus.

Reverting to FIG. 1B, as the slider 90 shifts upwardly along the main lever 85, driven lever 92 is able to swing through a greater arc. Conversely, as the slide 90 shifts downwardly, the swinging angle of the driven lever 92 become smaller, so that the stroke amount of the frame 74, in the direction of reciprocation, changes in proportion to a change in the swinging angle of the driven lever 92. Moreover, the greater the stroke amount of the frame 74 is, the faster the stroke speed thereof becomes. Conversely, when the frame 74 reduces its stroke amount, the stroke speed is smaller in proportion to the stroke amount.

Figure 8:
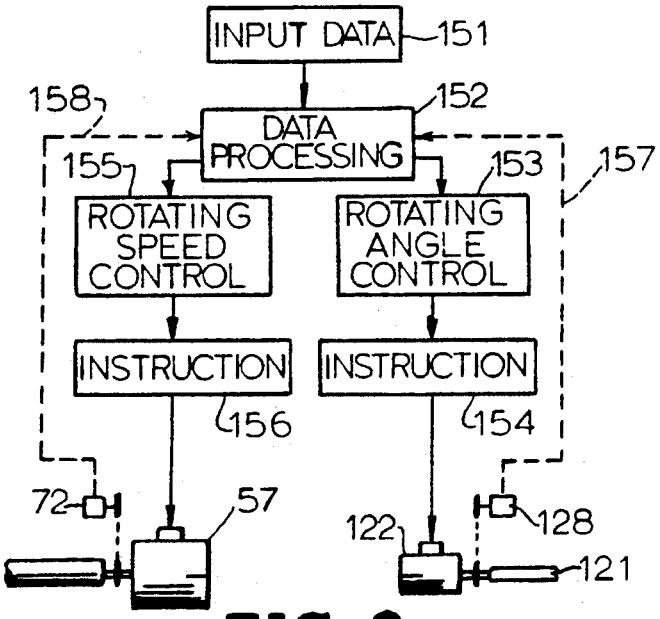
FIG. 8 is an explanatory block diagram of the invention according to the first embodiment in which solid lines represent generated control signals and dashed lines represent feedback signals.

In FIG. 6, as mentioned above, when a length of the wrapped product 46 is input to the microcomputer 150 as a numerical value from the keyboard 136, the microcomputer 150 automatically controls the speed of the pair of the seal bars 65 and 66 along the elliptical paths 64. Simultaneously, the microcomputer 150 controls the rotation of the second motor 57 so as to coordinate the feeding speed of film roll 56 with the stroke speed of the seal bars 65, 66. In other words, as shown in the diagram of FIG. 8 according to the first embodiment of the control mechanism, when the length of the wrapped product 46 is input 151 as data, the microcomputer processes the input 151 in data processing 152 to obtain a rotation angle 153 by computation and an instruction 154 which is given to the first motor 122 to displace the slider 90, and encoder 128 feeds back the rotation angle of motor 122 to the microcomputer. Simultaneously, the microcomputer computes 155 the control speed of the second motor 57 to give an instruction 156 thereto, and an encoder 72 feeds back 158 the speed of motor 57. In addition, in this case, rotation elements 47, 48, 61 and 62 (see FIG. 6) in contact with the film each are changed in speed to be synchronized thereto.

Figure 9:
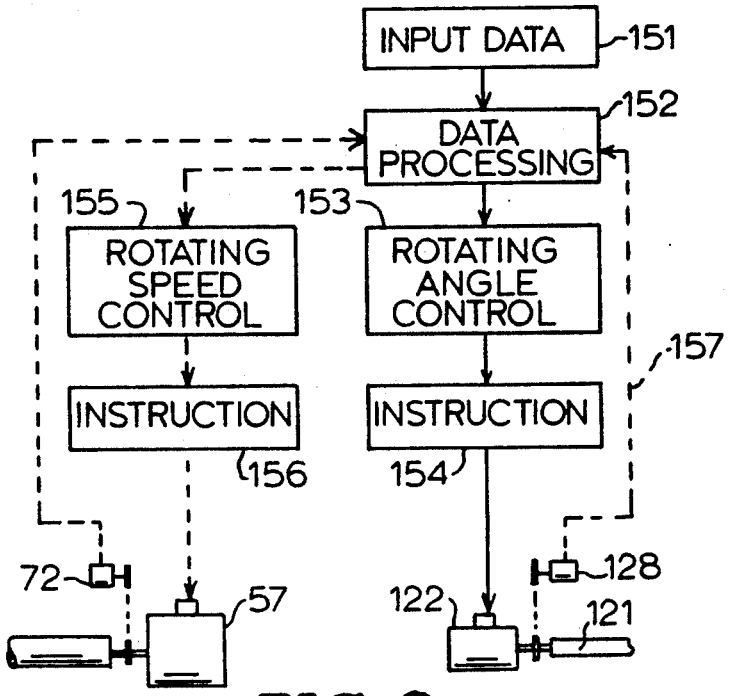
FIG. 9 is another explanatory block diagram of the invention according to a second embodiment in which solid lines represent generated control signals and dashed lines represent feedback signals.
Figure 10:
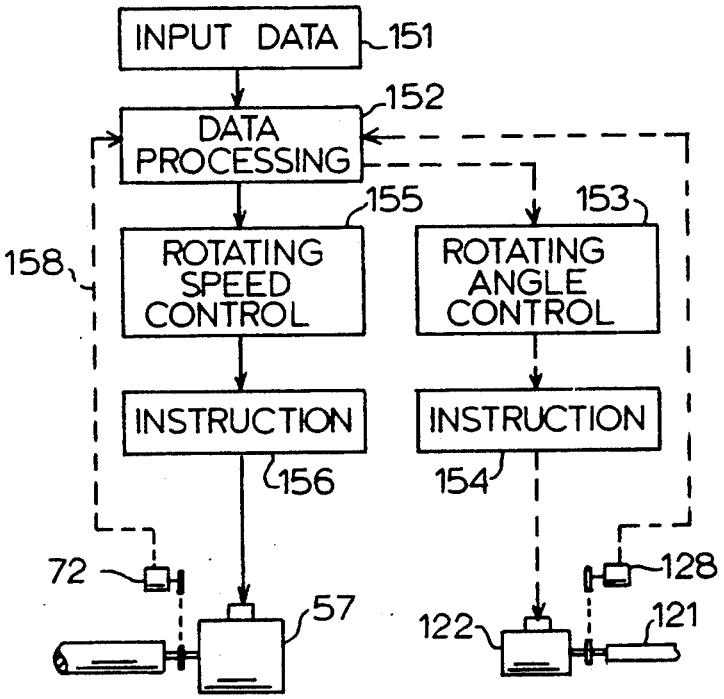
FIG. 10 is still another explanatory block diagram of the invention according to a third embodiment in which solid lines represent generated control signals and dashed lines represent feedback signals.
Figure 11:
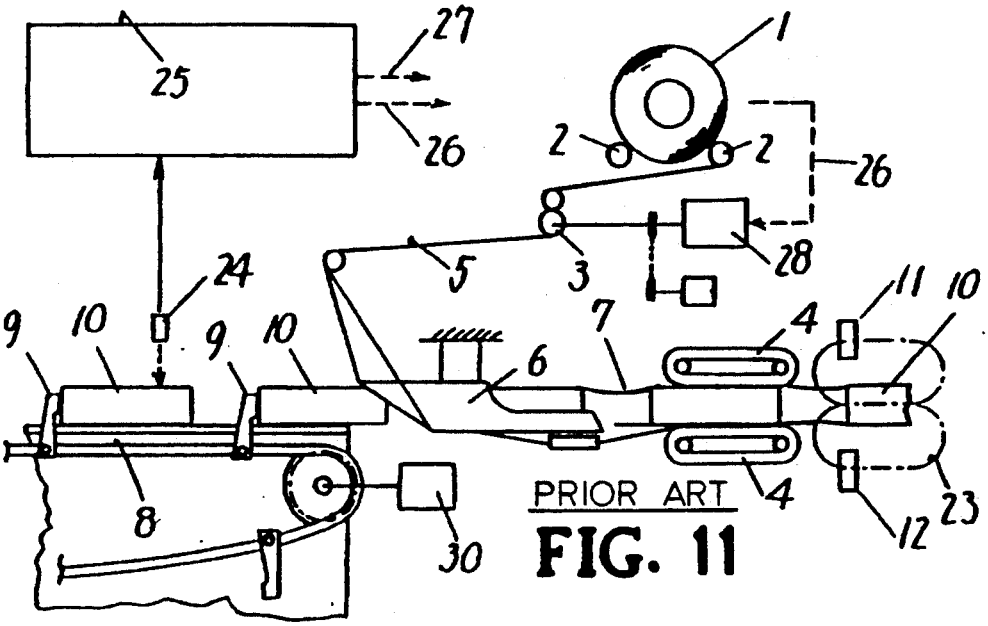
PRIOR ART FIG. 11
FIG. 11 is a side elevation view of a packaging machine of the prior art.
Figure 12:
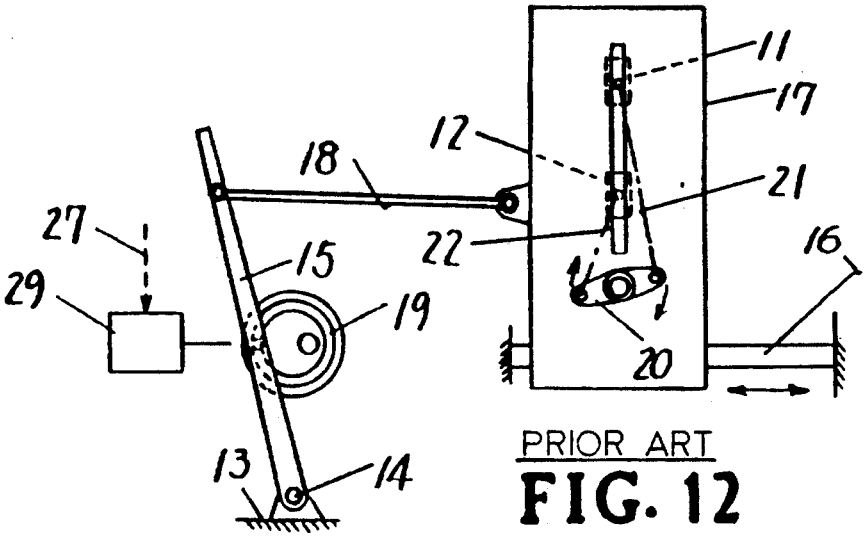
PRIOR ART FIG. 12
FIG. 12 is a side elevation view of the transverse sealing mechanism of the prior art.
Figure 13:
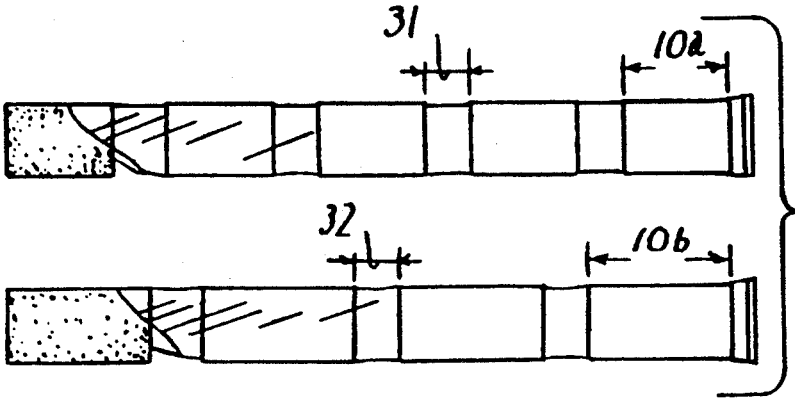
FIG. 13 is a schematic diagram of two series of products of different lengths being packed.

In the second embodiment of the control mechanism as shown in FIG. 9, when the microcomputer receives the data relating to the length of the to-be-wrapped product, it starts controlling the rotating angle of the screw shaft 121 by the rotation of the first motor 122 and represents that the feed speed of the film can be controlled by the second motor 57 on the basis of the feed-back signal 157 from the rotating angle detector 128. On the other hand, according to the third embodiment of the control mechanism as shown in FIG. 10, the film speed is first controlled by the second motor 57 and the rotating angle of the first motor 122 is controlled on the basis of the feed-back signal 158 from the encoder 72.

In summary, the apparatus of the present invention controls the angle of the screw shaft disposed along the main lever to be controlled in proportion to the length value of the to-be-wrapped product, changes the position of the slider by this screw shaft, increases the stroke of the frame supporting the seal bars in the reciprocating direction by this slider position control, and controls the speed and stroke of the sealing bars in proportion to the film speed. When the length of the to-be-wrapped product is to be increased, for example, the speed and stroke of the frame are increased proportional to the film speed. Accordingly, even when the film speed changes, the time of heating the film can always be kept constant, and production of products having inferior transverse seals can be prevented.

As described above, the preferred embodiment is intended as an example of the invention, and not as a limitation of its scope. Further variations as will be apparent to those skilled in the art, including the specific details of the control steps, are to be construed as within the principles taught herein and defined by the claims below.

I claim:

1. A packaging machine apparatus, comprising:

(a) a mechanism for gradually tubulating a belt-like film in a longitudinal direction of said film while conveying said film;

(b) a feed conveyor for equidistantly transferring to-be-wrapped products into said tubular film;

(c) a frame supported for reciprocal movement along a line parallel to the longitudinal direction of said tubular film;

(d) a seal mechanism supported by said frame and adapted for clamping said tubular film with a pair of seal bars for transversely sealing said tubular film when said frame moves in the same direction as said tubular film; and (e) a sealing control mechanism including means adapted to receive input data and calculate a value of the length of to-be-wrapped products transferred from said feed conveyor into said tubular film as an instruction and first electro-mechanical means responsive to said instruction for reciprocating said frame with a length of stroke and speed regulated in correspondence with said instruction and its relation to said length of to-be-wrapped products.

2. A packaging machine apparatus as claimed in claim 1 further including second electro-mechanical means responsive to said instruction for pulling and regulating the speed of conveying said film in correspondence with said instruction and its relation to said length of to-be-wrapped products.

3. A packaging machine apparatus as claimed in claim 1 wherein said first electro-mechanical means includes a lever pivotal on a machine base, a linkage between said lever and said frame, drive means for swinging said lever back and forth and lever length adjusting means responsive to said input data for regulating the length of said lever to vary the said stroke and speed of said frame.

4. A packaging machine apparatus as claimed in claim 2 wherein said first electro-mechanical means includes a first motor connected to drive means operative to regulate the stroke length and speed of said frame, said second electro-mechanical means includes a second motor connected to pull said film and said sealing control mechanism includes means responsive to said instruction to control the speed of both said first and second motors to synchronize the speed of said film with the speed and length of stroke of said frame in correspondence with the said length of said to-be-wrapped products.

5. A packaging machine apparatus, comprising:

(a) a mechanism for gradually tubulating a belt-like film in a longitudinal direction of said film while conveying said film;

(b) a feed conveyor for equidistantly transferring a series of to-be-wrapped products into said tubular film;

(c) a mechanism including a lever for transmitting swing motion of said lever swinging through a predetermined arc to a frame through a linkage and reciprocating said frame along a line parallel to the longitudinal direction of said tubular film;

(d) a seal mechanism supported by said frame and adapted for clamping said tubular film with a pair of seal bars and heating a selected portion of said tubular film when said frame moves in the same direction as said tubular film;

(d) an operation control apparatus for said seal mechanism including a screw shaft disposed on said lever and connected to be driven by a first motor, said frame being connected through a linkage to a threaded slider mounted on and positioned along the length of said lever by rotation of said screw shaft; and (f) a control mechanism for generating and transmitting control signals to said first motor and to a second motor for conveying a film and being adapted to receive and calculate a value of the length of to-be-wrapped products transferred from said feed conveyor into said tubular film as input data, and utilizing said input data to position said slider on said lever by signalling said first motor and the transfer speed of said film by signalling said second motor in correspondence with the value of the length of said to-be-wrapped products.

6. A packaging machine apparatus as claimed in claim 5, including a rotation angle detector connected to said first motor and to said control mechanism.

7. A packaging machine apparatus as claimed in claim 5 including a rotation speed detector connected to said second motor and to said control mechanism.

8. A method for wrapping a product in a film, comprising the steps of:

(a) conveying a heat sealable substantially continuous film in a longitudinal direction of said film while causing said film to form into a tube along said longitudinal direction;

(b) feeding a series of to-be-wrapped products individually into said formed film tube;

(c) clamping said film between a pair of seal bars oriented transverse to said direction and supported on a frame adapted for reciprocal movement along a line parallel to said direction so as to seal a selected portion of said film when said frame moves in said direction;

(d) calculating a value of the length of to-be-wrapped products from input data;

(e) generating an instruction relating to said calculated value; and (f) transmitting said instruction to electromechanical means responsive to said instruction so as to control the speed and stroke length of said frame and the conveying speed of said film feed.

9. The method for wrapping a product in a film as claimed in claim 8, further comprising:

(a) controlling a rotational angle of a first motor in said electromechanical means to vary a length of a linkage arm connected to said frame; and (b) controlling the speed of a second motor in said electromechanical means to vary the conveying speed of said film.

* * * * *